US006854604B2

(12) United States Patent
Soehnlen et al.

(10) Patent No.: US 6,854,604 B2
(45) Date of Patent: Feb. 15, 2005

(54) AUTOMATED DISPLAY MECHANISM

(75) Inventors: Daniel P. Soehnlen, Canton, OH (US); Gregory M. Soehnlen, North Canton, OH (US)

(73) Assignee: Creative Edge Design Group, LTD, Canton, OH (US)

( * ) Notice: Subject to any disclaimer, the term of this patent is extended or adjusted under 35 U.S.C. 154(b) by 188 days.

(21) Appl. No.: 10/401,168

(22) Filed: Mar. 27, 2003

(65) Prior Publication Data

US 2003/0160008 A1 Aug. 28, 2003

Related U.S. Application Data

(63) Continuation of application No. 09/875,577, filed on Jun. 6, 2001, now Pat. No. 6,595,374.

(60) Provisional application No. 60/210,087, filed on Jun. 7, 2000.

(51) Int. Cl.[7] ..... A47F 5/00

(52) U.S. Cl. ..... 211/1.57; 211/49.1; 108/147; 312/116; 62/246

(58) Field of Search ..... 211/59.2, 1.57, 211/49.1, 187, 59.4; 312/116, 408, 312, 319.5, 319.8; 108/107, 147; 700/217, 236, 305; 62/263, 440, 443, 246

(56) References Cited

U.S. PATENT DOCUMENTS 4,034,572 A * 7/1977 Morris et al. ..... 62/256
4,077,228 A * 3/1978 Schumacher et al. ..... 62/256
4,299,099 A * 11/1981 Myers et al. ..... 62/256
4,592,485 A * 6/1986 Anderson et al.
4,629,072 A * 12/1986 Loew ..... 211/59.3
RE33,515 E * 1/1991 Fershko et al. ..... 211/49.1
5,211,296 A * 5/1993 D'Heygere ..... 211/187
5,261,253 A * 11/1993 Spenard
5,490,600 A * 2/1996 Bustos ..... 211/187
5,706,956 A * 1/1998 Headrick et al. ..... 211/59.2
6,269,285 B1 * 7/2001 Mignault ..... 700/236
6,309,034 B1 * 10/2001 Credle et al. ..... 312/116
6,595,374 B2 * 7/2003 Soehnlen et al. ..... 211/1.57

* cited by examiner

*Primary Examiner*—Robert W. Gibson, Jr.
(74) *Attorney, Agent, or Firm*—Fay, Sharpe, Fagan, Minnich & McKee, LLP

(57) ABSTRACT

A store display maximizes shelf space through use of an automated lift assembly that selectively positions product, for example milk containers, at an opening in a wall. The wall defines a customer side and a store side, and the lift assembly monitors product available through the opening and selectively raises additional product from a stacked array into position at the opening. Helical threaded members are preferably disposed on opposite sides of a pallet, or support platform, and are driven in unison in response to a signal from a sensor that product is depleted from an upper level of the stacked array.

16 Claims, 4 Drawing Sheets

AUTOMATED DISPLAY MECHANISM

CROSS-REFERENCE TO RELATED APPLICATIONS

This application is a continuation of application Ser. No. 09/875,577, filed Jun. 6, 2001, now U.S. Pat. No. 6,595,374, which claims the benefit of provisional application Ser. No. 60/210,087, filed Jun. 7, 2000.

BACKGROUND OF THE INVENTION

1. Field of the Invention

This invention relates to a display assembly or case, particularly of the type used to market products in a supermarket or department store, for a high volume item that needs to be continually replenished and/or where there exists a particular need to improve shelf or display space.

2. Discussion of the Art

It is common, for example, in refrigerated display cases associated with dairy products at a supermarket, to have a predetermined area in which one gallon or three liter containers of milk are sold. This is a high volume item that must be continually replenished and/or stocked. Labor and costs associated with the continual replenishment of milk are areas where there is a need for improvement and development. For example, one recent innovation is the development of caseless shipping to reduce the costs associated with shipping or transporting containers of milk. Conventional cases for shipping milk containers are eliminated at a substantial cost savings to the industry. More particular details are disclosed in commonly owned U.S. Pat. No. 6,068,161 which is hereby incorporated by reference.

Conventional displays for milk at the supermarket or store include a refrigerated bin or enlarged compartment in which the milk containers are manually stacked in layers three or four high, each layer separated from an adjacent layer by a plastic floor. As layers of milk containers are removed by the consumer, the plastic layer is subsequently removed to allow access to the next lower row in the column. This process continues until the bin is emptied and/or replenished by the store employee.

Adjacent this high volume milk product are other refrigerated fruit juices or dairy products. For example, a predetermined space is provided for half gallon varieties of milk, cottage cheese, yogurt, etc. As will be appreciated, these items do not experience the high turnover of the gallon/three liter milk containers and thus do not require continual replenishment by the store worker.

SUMMARY OF THE INVENTION

The present invention contemplates a new and improved automated display mechanism that overcomes the above referenced problems and others and provides a simple, economical arrangement that substantially reduces labor associated with stocking product and reduces display or shelf requirements.

An exemplary embodiment of the invention includes a platform dimensioned to support a stacked array of product. The platform is selectively raised as the product from the uppermost row is removed by customers so that the remaining stacked product in the array is incremented upwardly to maintain a full display shelf.

The platform is selectively driven in response to a signal from a sensor or monitor indicating that the uppermost row has been depleted.

A preferred embodiment includes first and second columns disposed in spaced relation. Support members are mounted on the columns and receive a pallet that supports a stacked array of product. The support members in conjunction with the pallet define a platform that selectively raises and lowers the product as needed.

The columns are preferably electrically driven threaded members each having a follower received on the threaded column that is selectively raised and lowered as the threaded member is rotated.

A primary advantage of the invention resides in the reduced labor associated with the display of product.

Another advantage of the invention resides in the ability to continually replenish product as it is used.

Yet another advantage of the invention resides in the decreased shelf or display space required for a product.

Still other advantages and benefits of the invention will become apparent to those skilled in the art upon reading and understanding the following detailed description.

DETAILED DESCRIPTION OF THE INVENTION

Figure 1:
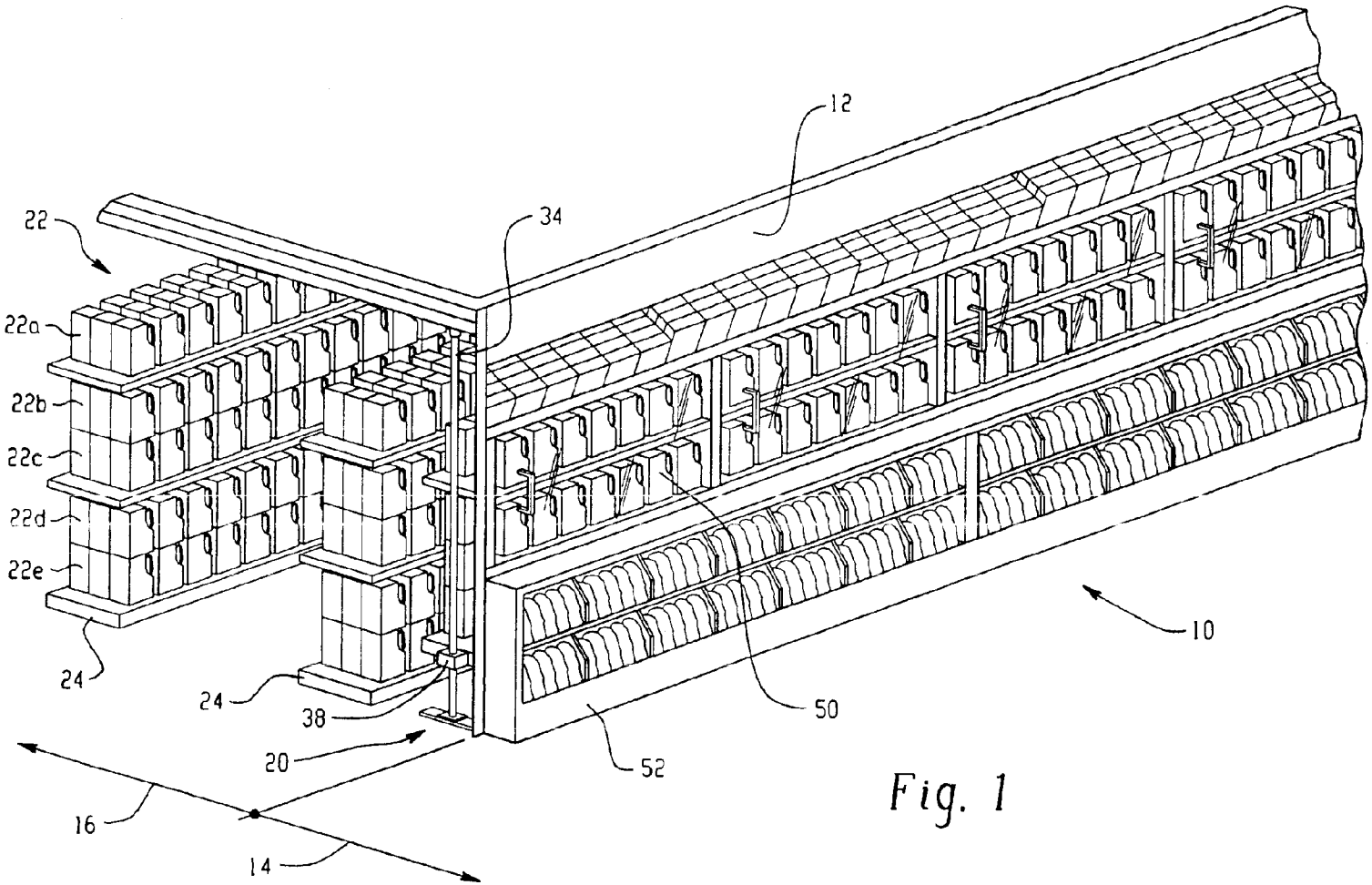
FIG. 1 is a perspective view of a preferred display assembly incorporating features of the present invention.

FIG. 1 illustrates a portion of a supermarket, particularly refrigeration display cases 10 associated with milk containers and other refrigerated food products. The refrigerated display 10 includes a wall 12 that separates a customer side 14 from a store side 16. In this particular instance, the wall 12 encloses a refrigerated store side 16, although it will be appreciated that the store side may be smaller refrigerated cabinets or a non-refrigerated region.

The display wall 12 can adopt a wide variety of configurations. It is believed, however, that a particularly useful conformation of display cases is illustrated in the FIGURES. An automated display mechanism 20 in accordance with the present invention is associated with a high volume item, illustrated as one gallon or three liter containers of milk 22, stacked on pallets or support platforms 24 as received from a dairy. Commonly owned U.S. Pat. No. 6,068,161 describes a unique container that provides caseless shipping of three liter milk containers in a stacked array at a substantial cost savings to the store.

Figure 2:
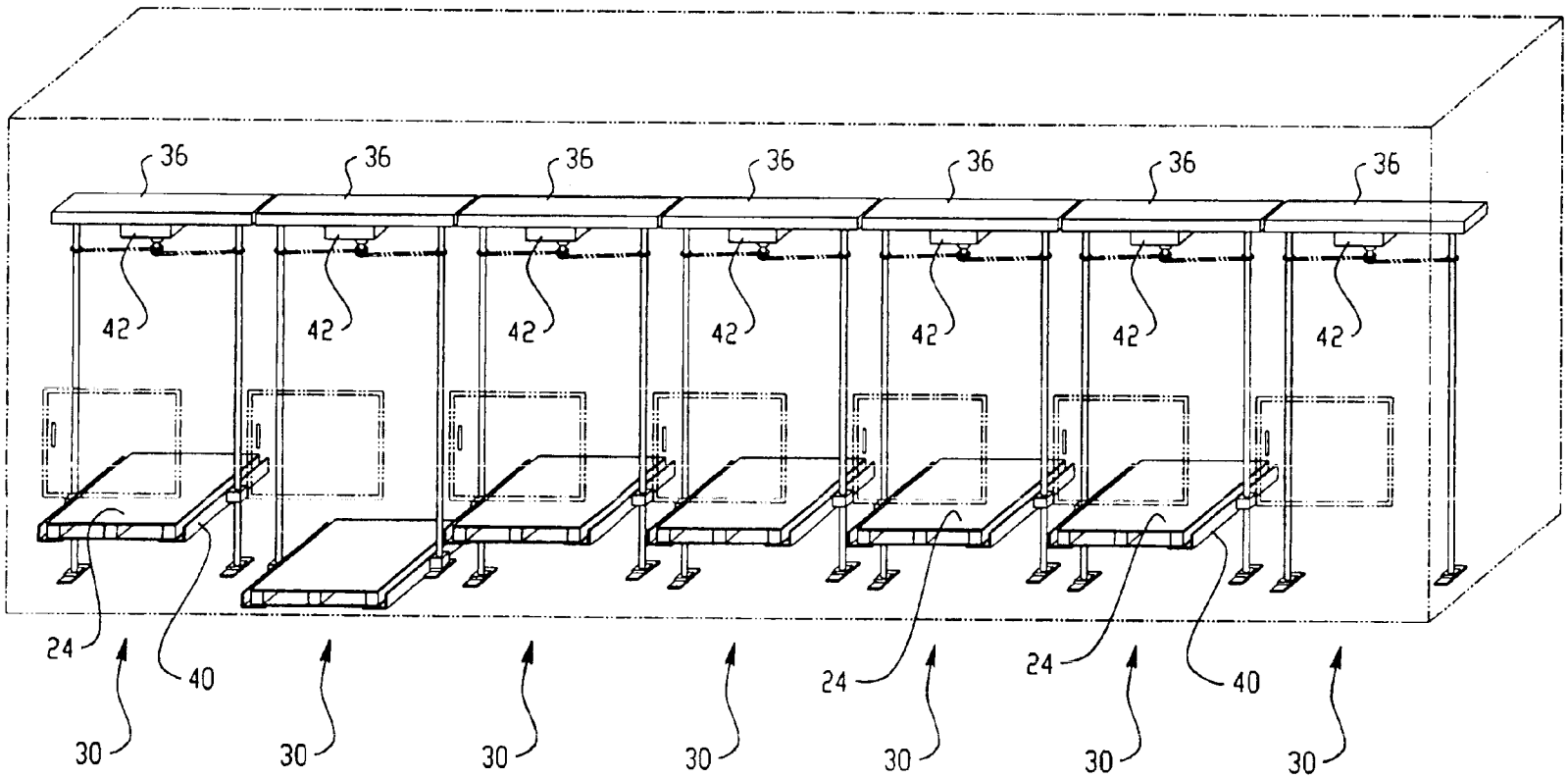
FIG. 2 is a perspective view of a series of automated display mechanisms.

With continued reference to FIG. 1, and additional reference to FIG. 2, the particular structural and functional aspects of the automated display mechanism will be discussed in greater detail. A series of automated display mechanisms or units 30 define individual bays or loading stations on the store side 16 of the display assembly. Here, the automated units are disposed in end-to-end linear alignment, although the units can also be used individually or at different locations in a store. Likewise, the various units are shown at different heights to represent the versatility and function of each unit. As will become more apparent below, the units are loaded with product in a lowered position and, once emptied, are normally disposed at a raised height before being returned to a lower position to receive additional product.

Figure 3:
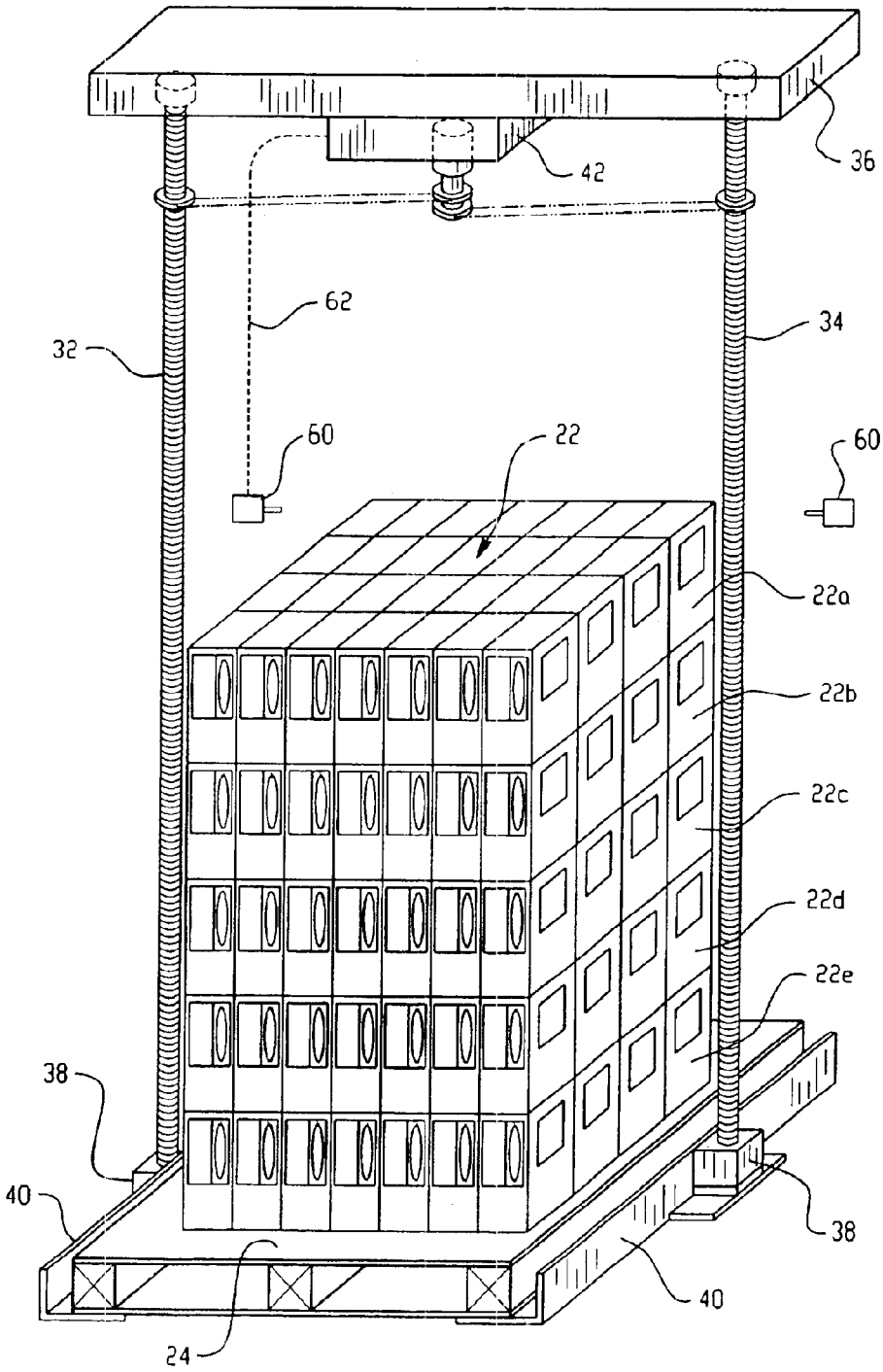
FIG. 3 is a perspective view of an individual display mechanism unit.
Figure 4A:
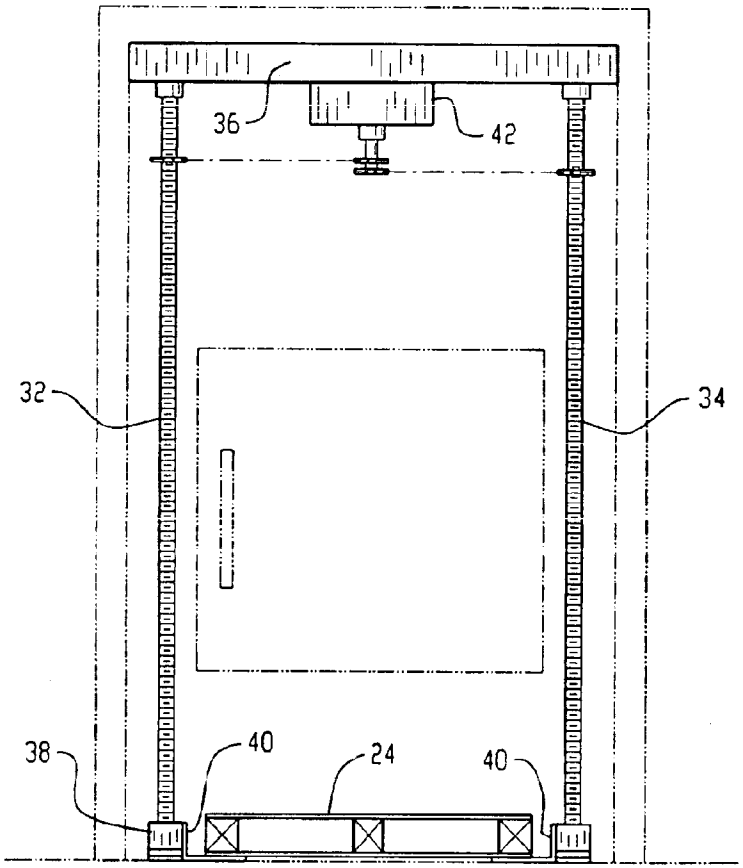
FIGS. 4A and 4B are elevational views of an individual display mechanism unit.
Figure 4B:
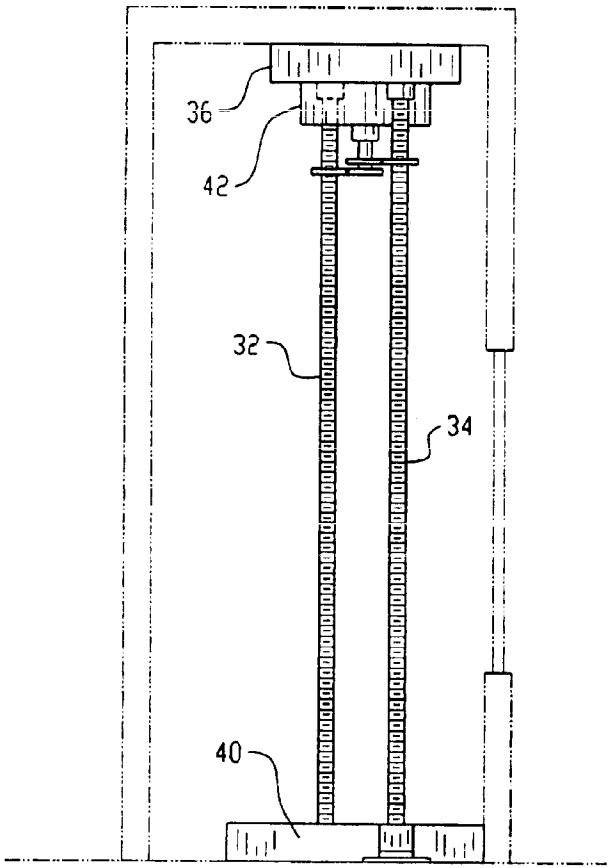

An exemplary embodiment of an individual display mechanism is illustrated in FIG. 3. It includes first and second columns 32, 34 disposed in an upright, parallel vertical relation. Upper ends of the upright members are held in spaced relation by a bridging member 36. Each column 32, 34 is preferably a threaded member, i.e., an elongated helically threaded member. Mounted on each of the threaded members is a follower 38 that axially travels along the respective threaded member in response to rotation of the threaded member. The axial travel of the followers 38 results in support members 40 secured to the followers being selectively raised and lowered along the height of the columns 32, 34. A drive assembly 42, for example a chain drive mechanism, simultaneously drives or rotates the first and second threaded members 32, 34 and thereby selectively raises and lowers the support members in unison.

As will be appreciated, the support members 40 are configured to receive the pallet 24 along opposite edges. It is also contemplated that the support members may be interconnected, i.e., span the gap between the columns by a support tray or generally rigid planar member(s) that support the pallet.

As illustrated in FIG. 3, the milk containers are stacked in an array on the pallet. In the exemplary arrangement the milk containers are stacked five high on the pallet. Upper two rows 22*a*, 22*b* are disposed at a door level 50 provided in the wall 12 when the pallet is in its lower position. Display region 52 is located below the doors and has a height that generally matches the height of the lower three rows 22*c*, 22*d*, 22*e* and the supporting pallet. This second display region 52 is stocked in a conventional manner and in some instances is only accessible from the customer side 14. Since the second display region has items that do not turn over as quickly, less labor and cost is associated with stocking these items.

When a pallet is originally advanced into the automated display unit as illustrated in FIG. 3, the upper two rows are positioned for easy access by the consumer through door 50. Once the upper or first row 22*a* has been depleted, a sensor 60 detects that the milk containers must be replenished. The drive mechanism 42 receives a signal 60 as represented by the dashed line 62. Any conventional type of sensing arrangement, such as an optical sensor, monitors the uppermost layer or row of the stacked products. Once the upper layer is depleted, the drive assembly 42 then advances the support members 40, pallet 24, and remaining layers of milk containers upwardly. This positions two layers of product in the display region 50 until the pallet is raised to the bottom of the display window. Once the lowermost row is depleted, the sensor and drive assembly rotates the threaded members in the opposite direction so that the pallet is lowered to the floor. The pallet is then removed and a new pallet supporting a stacked array of containers can be positioned in the display mechanism. It will also be appreciated that the return of the pallet to the floor can be achieved via an override switch that allows store employees to independently control the height of the pallet if desired.

This automated display mechanism enhances the features associated with caseless shipping. It also substantially reduces or eliminates labor associated with stocking display shelves with product. In essence, three additional shelves of product are created by using a selectively raised and lowered pallet so that the product is continually replenished. It also maximizes the efficiency of product in the store. That is, a smaller linear footage of shelf or display area is required as a result of using the automated display unit.

The invention has been described with reference to the preferred embodiment. Obviously, modifications and alterations will occur to others upon a reading and understanding of this specification. For example, rather than threaded members, another lifting or raising assembly can be used with equal success. For example, a pneumatic, hydraulic, chain drive system, etc. could be used with equal success in response to the sensor assembly to selectively raise and lower the rows of product as desired. This invention is intended to include all such modifications and alterations, or the equivalents thereof.

Having thus described the invention, we claim:

1. An automated display assembly for a store comprising:

a wall separating a customer side from a store side, and having an opening passing therethrough at an elevated height;

a platform received on the store side of the wall dimensioned to received associated product in stacked array thereon;

a lift operatively engaging the platform and selectively raising the platform to orient an uppermost row of associated product at the opening;

a sensor for monitoring associated product in an uppermost layer; and a drive mechanism associated with the lift for selectively altering a height of the platform in response to a signal from the sensor.

2. The automated display assembly of claim 1 wherein the lift includes first and second lift members disposed on opposite sides of the platform.

3. The automated display assembly of claim 2 wherein the drive mechanism includes a common drive for operating the first and second lift members in unison.

4. The automated display assembly of claim 1 wherein the lift include an elongated helically threaded member and a follower received thereon.

5. The automated display assembly of claim 1 wherein the platform is a pallet preloaded with product.

6. A store display assembly comprising:

a wall separating a customer side from a store side that is refrigerated, and an opening at an elevated height in the wall providing access therethrough from the customer side to the store side; and a lift assembly on the store side of the wall that selectively raises associated refrigerated product to the opening as product is depleted.

7. The store display assembly of claim 6 further comprising doors covering the opening and providing selective access therethrough.

8. The store display assembly of claim 6 wherein the lift assembly includes a platform supporting product thereon in a stacked array.

9. The store display assembly of claim 6 wherein the lift assembly includes first and second lift members disposed on opposite sides of the platform.

10. The store display assembly of claim 6 wherein the lift assembly includes a platform dimensioned to receive a stacked array of associated product, a lift operatively engaging the platform and selectively raising the platform to locate associated product at the wall opening, and a sensor for monitoring associated product in an uppermost layer.

11. The store display assembly of claim 10 wherein the lift assembly includes a drive mechanism operatively associated with the lift for selectively raising the platform in response to a signal from the sensor.

12. The store display assembly of claim 10 wherein the lift assembly includes first and second lift members disposed on opposite sides of the platform, and a common drive for operating the first and second lift members in unison.

13. The store display assembly of claim 10 wherein the lift includes an elongated helically threaded member and a follower received thereon.

14. A method of displaying product in a store comprising the steps of:

providing a stacked array of a product on a lift assembly;

monitoring an uppermost row of product on the stacked array; and automatically raising the lift assembly as product is depleted from the uppermost row.

15. The method of claim 14 wherein the product providing step includes providing milk containers stacked on pallets as shipped from a dairy.

16. The method of claim 15 wherein the automatically positioning step includes incrementally raising the pallet as individual layers of milk containers are removed.

* * * * *